United States Patent [19]

Petersen

[11] Patent Number: 4,541,228

[45] Date of Patent: Sep. 17, 1985

[54] APPARATUS FOR PACKAGING PORTIONS OF ELONGATE ARTICLES

[76] Inventor: Gunnar C. Petersen, No. 14, Rodkildevaenget, 5230 Odense M, Denmark

[21] Appl. No.: 609,801

[22] Filed: May 14, 1984

[30] Foreign Application Priority Data

May 25, 1983 [DK] Denmark ..... 2352/83

[51] Int. Cl.[4] ..... B65B 5/06; B65B 35/34; B65B 43/30

[52] U.S. Cl. ..... 53/572; 53/255; 53/386; 141/74; 141/114; 141/313; 198/530

[58] Field of Search ..... 53/251, 255, 386, 525, 53/570, 571, 572, 573; 141/10, 68, 74, 114, 313, 314, 315, 316, 317; 198/505, 530, 532; 222/56, 199

[56] References Cited

U.S. PATENT DOCUMENTS

| | | | |
|---|---|---|---|
| 3,058,621 | 10/1962 | Stenzel | 198/530 X |
| 3,075,324 | 1/1963 | Burks et al. | 53/572 X |
| 3,747,810 | 7/1973 | Graser | 222/199 |
| 4,137,958 | 2/1979 | Golby et al. | 53/572 X |

FOREIGN PATENT DOCUMENTS

| | | | |
|---|---|---|---|
| 0132651 | 10/1978 | Fed. Rep. of Germany | 198/530 |
| 2804699 | 8/1979 | Fed. Rep. of Germany . | |

*Primary Examiner*—Robert L. Spruill
*Assistant Examiner*—Michael D. Folkerts
*Attorney, Agent, or Firm*—Stevens, Davis, Miller & Mosher

[57] ABSTRACT

The apparatus comprises an inclined chute to which the articles are delivered in portions and from which they slide down into a tray which oscillates in a horizontal direction together with the chute. The tray is open at its end remote from the chute and at the top, but closed on its remaining sides. The tray is pivotally supported in extensions of the chute side walls so that it can pivot between a horizontal loading position and a vertical discharge position. In front of the open end of the tray there is provided a vertical plate which is coupled to the chute and the tray in such a way that in the horizontal position of the tray it closes the open tray end while in response to the pivoting of the tray to vertical position it is moved some distance down into the mouth of a subjacent bag, substantially retaining its vertical orientation. During the emptying of the tray the plate functions as one of the walls defining a discharge opening through which the articles are transferred to the bag.

4 Claims, 6 Drawing Figures

APPARATUS FOR PACKAGING PORTIONS OF ELONGATE ARTICLES

BACKGROUND OF THE INVENTION

This invention relates to an apparatus for packaging portions of elongate articles, such as carrots. The apparatus comprises an elongate receptacle and means for pivoting the receptacle from a horizontal loading position to a vertical discharge position above the mouth of an open bag, means for loading a portion of the articles into the receptacle when the latter assumes its horizontal loading position, and shaking means for imparting longitudinal oscillations to the receptacle and its content.

In an apparatus of this kind, which is known from published German Patent Application No. 28 04 699 the shaking of the receptacle serves for imparting a certain degree of lengthwise orientation to the articles, which are loaded from above into the receptacle, in order to facilitate the subsequent transfer of the articles to a bag in response to the pivoting of the receptacle to vertical position. In the known apparatus the receptacle is provided with a lid which is kept open during the loading of the articles and which is thereafter closed before the receptacle is pivoted. One end wall of the receptacle is composed of two flaps which are kept closed during the shaking and the subsequent pivoting movement. When the receptacle is vertically positioned it is moved downward through a certain distance into the bag following which the flaps are opened to let the articles fall down into the bag.

SUMMARY OF THE INVENTION

It is an object of the present invention to provide an apparatus which is substantially simpler than the known apparatus and consequently also more reliable in operation, and which can operate at a high throughput.

According to the present invention, an apparatus for packaging portions of elongate articles comprises in combination: A frame, an elongate chute supported by the frame and having two side walls and a bottom sloping towards a lower front edge thereof, means for supplying a portion of articles to the chute, shaking means for imparting longitudinal oscillating movements to the chute, an elongate, upwardly open tray having a bottom wall, two side walls pivotally supported by extensions of the chute side walls, a rear wall, and an open end opposite the rear wall, means for pivoting the tray between a loading position in which its bottom wall is substantially horizontal and its rear wall is located shortly in front of, and below, the front edge of the chute bottom, and a discharge position in which its bottom wall is substantially vertical and its open end oriented downward, means for positioning an open bag with the mouth thereof below the open end of the tray when the latter is in the discharge position, a substantially vertically oriented plate movable between an uppermost end position in which it obturates the open end of the tray when the latter assumes the loading position, and a lowermost end position in which the plate projects into the mouth of the open bag, and means for shifting the plate between its end positions in timed relationship with the pivoting of the tray.

During operation of the apparatus portions of the articles to be packaged will be supplied intermittently to the chute from which the articles will slide along the chute bottom into the tray which forms the pivotal transfer receptacle of the apparatus. Due to the horizontal oscillations of the chute and the tray the articles will be introduced into the tray one by one rather than all at once, and already at the time of their introduction they will have obtained at least a certain orientation in the longitudinal direction of the tray. It is therefore possible, with a relatively short shaking period, to obtain a sufficient alignment of the articles before the tray is pivoted to its discharge position. The coupling of the chute to the shaking means makes it possible to keep the shaking means separate from the means for pivoting the tray between horizontal and vertical positions, since the latter means will be connected between the chute and the tray. The vertically oriented plate solves, in a simple manner, the problem of emptying the tray rapidly without involving the risk that an article falls beside the bag, since the downward movement of the plate into the mouth of the bag occurs in timed relationship with the formation, between the front edge of the tray bottom and the plate, of an opening which gradually gets wider during the pivoting of the tray.

In a structurally simple embodiment of the invention the means for shifting the plate between its end positions may comprise a link and pivot means which, directly or through an intermediate subframe, connect respectively the upper part of the plate with the chute and the lower part of the plate with the side walls of the tray. A separate mechanism for moving the plate up and down and for synchronizing the movements of the plate and the tray is thus dispensed with.

BRIEF DESCRIPTION OF THE DRAWINGS

The invention will now be described in more detail with reference to the accompanying, schematical drawings in which.

DETAILED DESCRIPTION

Figure 1:
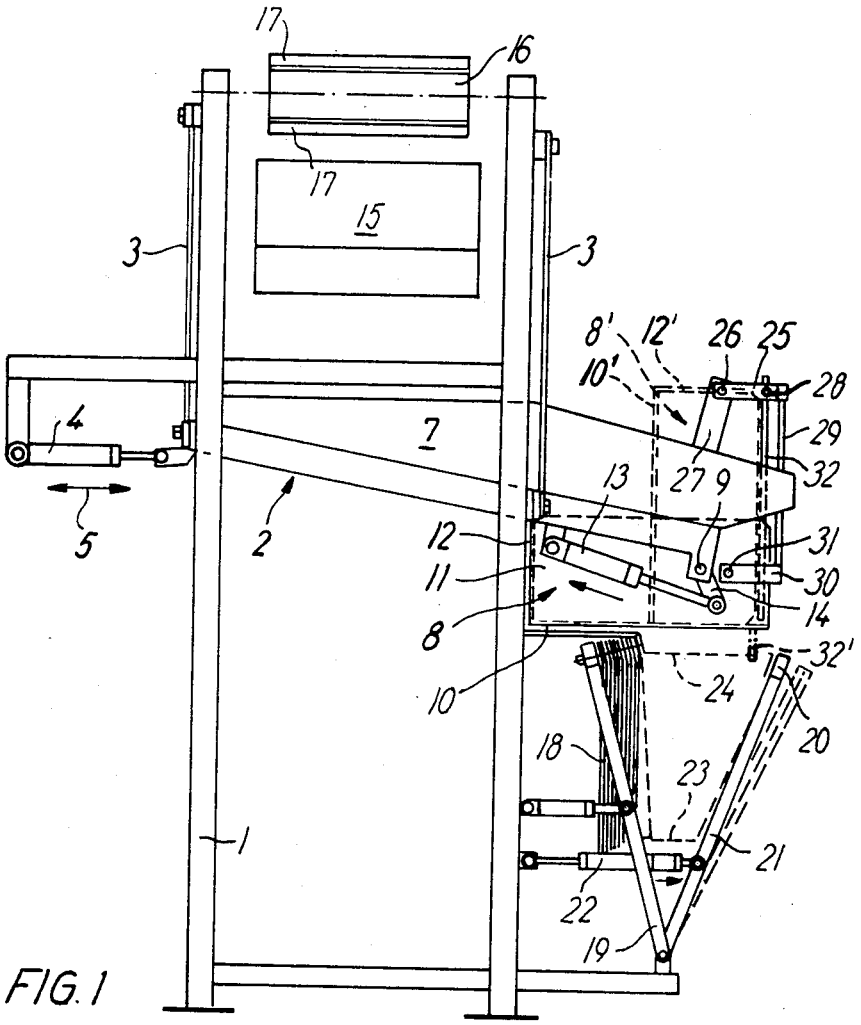
FIG. 1 is an elevation of an apparatus embodying the invention.

The apparatus illustrated in the drawings comprises a frame 1 in which a chute generally designated by 2 is suspended by means of leaf springs 3 which preferably are made of glass fibre reinforced polyester plastic. Between the rear end of chute 2, in FIG. 1 the left-hand end, and frame 1 there is connected a pneumatic ram 4 which serves for imparting an oscillating horizontal movement to chute 2, as shown by a double arrow 5. The frequency of the oscillations may be chosen about 5 Hz.

The chute 2 has a bottom wall 6 which slopes downwardly towards its front end, and two vertical side walls 7. The side walls 7 are extended forwardly beyond the front edge of bottom 6, and in the extended side walls a rectangular tray 8 is pivotally supported by means of two axially aligned pivot pins 9. Tray 8 has a bottom wall 10, two side walls 11 to which the pivot pins 9 are secured, and a rear wall 12. In the horizontal or loading position of the tray, as shown in full lines in FIG. 1, rear wall 12 is located immediately in front of the front edge of the bottom wall 6 of chute 2. By means of a pneumatic ram 13, which is connected between the extension of one side wall 7 and a pivot arm 14 secured to one pivot pin 9, the tray 8 may be pivoted between the horizontal position mentioned above and a vertical or discharge position which is shown in dotted lines at 8' in FIG. 1.

Above the bottom wall 6 of chute 2 a weighing hopper 15 is mounted, in a manner not shown in detail, in frame 1 and the weighing hopper is supplied with the articles to be packaged, for example carrots, from a superjacent conveyor 16 provided with transverse carriers 17 between which pockets for the transportation of the articles are formed.

A stack 18 of bags, in which the articles are to be packaged, is suspended from a holder 19 secured to frame 1 below tray 8. By means of a suction head 20 mounted on a pivoting lever 21, which can be moved towards and away from the stack 18 of bags by means of a pneumatic ram 22, the front part of the foremost bag 23 in the stack can be gripped at an appropriate moment of the working cycle of the apparatus and advanced so as to open the bag, as shown in dotted lines in FIG. 1. When the bag has been opened and the tray has been pivoted to its vertical position shown at 8' in FIG. 1, the upwardly oriented mouth 24 of the bag will be located below the open front end of the tray.

Figure 2:
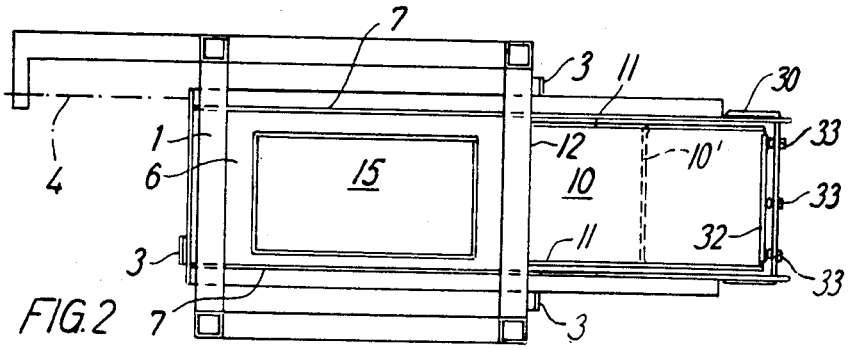
FIG. 2 is a plan view of FIG. 1.
Figure 3:
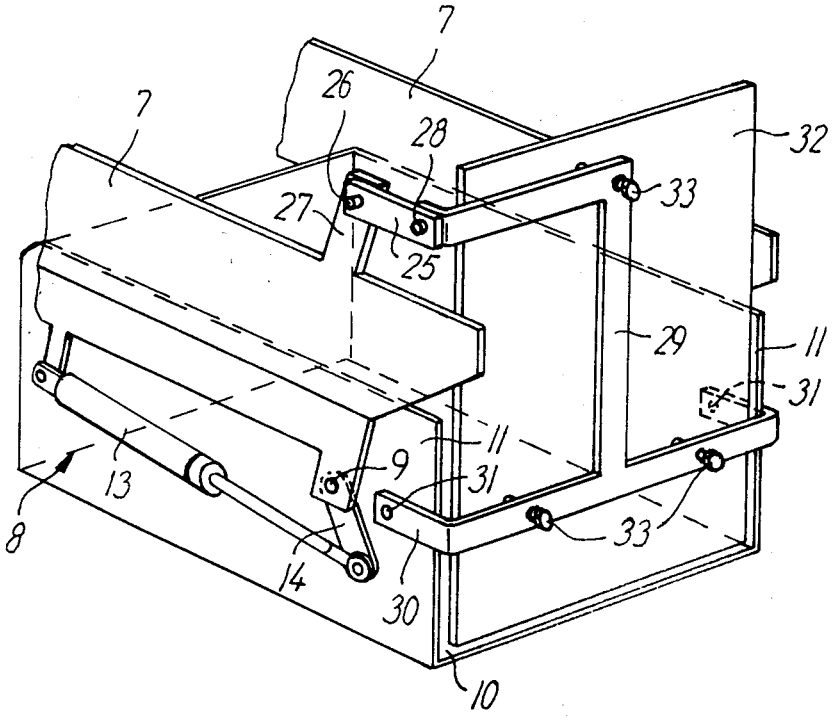
FIG. 3 is an enlarged perspective view of the tray and the vertically oriented plate together with the pivoting means.

As shown in more detail in FIG. 3, one end of a link 25 is, by means of a pivot pin 26, hingedly connected to an arm 27 extending upwardly from the extension of one side wall 7. By means of a pivot pin 28 the other end of link 25 is connected to a horizontal upper limb of a subframe 29. A horizontal lower limb of subframe 29 is formed with two right-angled end portions 30 which straddle the side walls 11 of tray 8, to which they are hingedly connected by aligned pivot pins 31. A vertically oriented plate 32 is secured to subframe 29 by means of three adjusting screws 33. As shown in FIGS. 2 and 3, plate 32 fits between the side walls 11 of tray 8 with a small clearance, and screws 33 permit adjustment of the position of the plate relative to the tray.

Figure 4A:
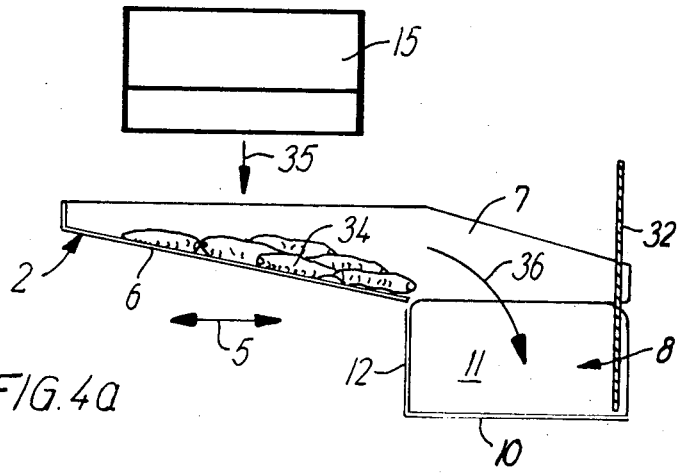
FIGS. 4*a*, 4*b*, and 4*c* illustrate three successive stages during the working cycle of the apparatus.

The function of the apparatus shown will now be described with particular reference to FIGS. 4*a* to 4*c*.

Conveyor 16 is operated intermittently thereby supplying the articles in question to weighing hopper 15. When a portion having a desired weight has been accumulated in hopper 15, conveyor 16 is stopped and the bottom of the weighing hopper is opened whereby the articles 34 fall down into chute 2, as indicated by an arrow 35 in FIG. 4*a*. During this period chute 2 and tray 8, which is coupled to the chute, reciprocate in the direction of arrow 5 so that the articles 34 move quickly from the chute into the tray one after the other, as shown by an arrow 36. Simultaneously, the articles become aligned in their longitudinal direction to a certain extent, in any event so much that when the portion has been completely transferred to the tray, as shown in FIG. 4*b*, there are no transversely oriented articles. During this part of the working cycle of the apparatus, in which tray 8 is horizontal, the position of plate 32 is that shown in FIGS. 4*a* and 4*b*, in which it closes the open right-hand end of the tray. As will appear from the above description and from FIGS. 1 and 3, plate 32 participates in the oscillating movement of chute 2 and tray 8.

Figure 4B:
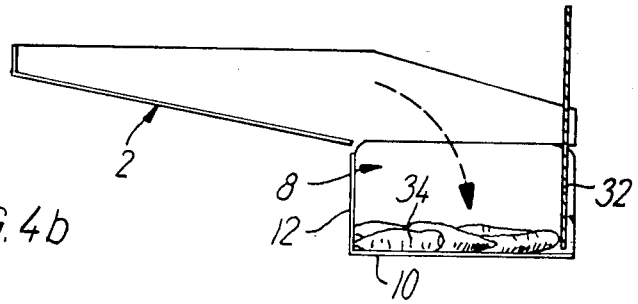
Figure 4C:
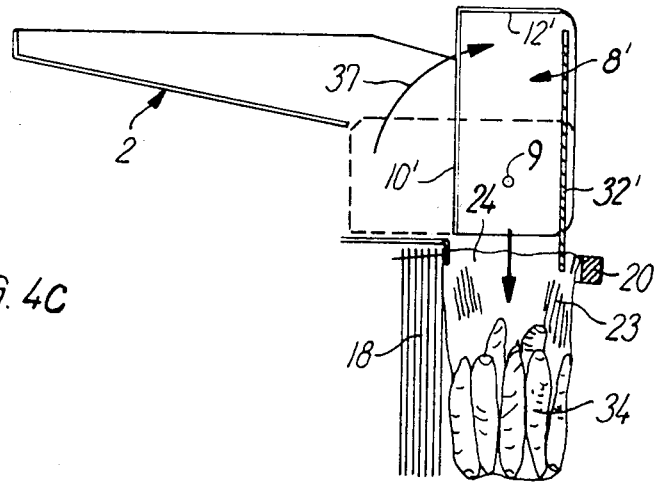

When the situation shown in FIG. 4*b* has been reached, the oscillating movement of chute 2 and tray 8, including plate 32, is stopped and bag 23 is opened as described above. Ram 13 is then actuated to pivot the the tray to the position 8' shown in full lines in FIG. 4*c*, and during this pivoting movement, as illustrated by arrow 37, frame 29 moves downwardly and rearwardly, i.e. towards the left in FIG. 1, due to its connection, via link 25 and pivot pins 31, with the chute and the tray, respectively. Plate 32, which is secured to the frame, also moves slightly to the rear and at the same time down into the bag mouth 24 to the position designated by 32'. This movement takes place gradually and in timed relationship with the occurrence of a gradually increasing opening between the front edge of tray bottom wall 10 and plate 32. Through that opening the articles 34 fall down into bag 23, and in response to the fall of the articles the bag is detached from holder 19. The detached and filled bag may fall down onto a subjacent conveyor (not shown) which carries the bag to a bag closing device. Tray 8 pivots back to horizontal position and at the same time plate 32 returns to its uppermost end position following which a new working cycle may start.

I claim:

1. Apparatus for packaging portions of elongate articles; comprising a frame, an elongate chute supported by the frame and having two side walls and a bottom sloping towards a lower front edge thereof, means for supplying a portion of articles to the chute, shaking means for imparting longitudinal oscillating movements to the chute, an elongate, upwardly open tray having a bottom wall, two side walls pivotally supported by extensions of the chute side walls, a rear wall and an open end opposite the rear wall, means for pivoting the tray between a loading position in which its bottom wall is substantially horizontal and its rear wall is located shortly in front of, and below, the front edge of the chute bottom, and a discharge position in which its bottom wall is substantially vertical and its open end is oriented downwards, means for positioning an open bag with the mouth thereof below the open end of the tray when the latter is in the discharge position, a substantially vertically oriented plate movable between an uppermost end position in which it obturates the open end of the tray when the latter assumes the loading position, and a lowermost end position in which the plate projects into the mouth of the open bag, and means for shifting the plate between its end positions in timed relationship with the pivoting of the tray.

2. Apparatus as claimed in claim 1, wherein said means for shifting the plate between its end positions comprises a link connecting the upper part of the plate with the chute, and pivot means connecting the lower part of the plate with the side walls of the tray.

3. Apparatus as claimed in claim 1, further comprising a vertically oriented subframe to which the plate is secured by means of fastening members which provide for an adjustability of the plate in a horizontal direction.

4. Apparatus as claimed in claim 3, wherein said means for shifting the plate between its end positions comprises a link connecting an upper part of the subframe with the chute, and pivot means connecting a lower part of the subframe with the side walls of the tray.

* * * * *